US005996802A

United States Patent [19]

Parker et al.

[11] Patent Number: 5,996,802

[45] Date of Patent: Dec. 7, 1999

[54] CARRIER FOR ICE CREAM CONES AND THE LIKE

[76] Inventors: Michael F. Parker; Emma I. Parker, both of 845 Read St., Attleboro, Mass. 02703

[21] Appl. No.: 09/169,475

[22] Filed: Oct. 10, 1998

Related U.S. Application Data

[60] Provisional application No. 60/061,840, Oct. 14, 1997, and provisional application No. 60/082,342, Apr. 20, 1998.

[51] Int. Cl.[6] ..... B65D 1/34

[52] U.S. Cl. ..... 206/563; 229/932

[58] Field of Search ..... 206/541, 562, 206/563, 564; 229/932, 938; 426/139

[56] References Cited

U.S. PATENT DOCUMENTS

| | | | |
|---|---|---|---|
| D. 261,466 | 10/1981 | Harper . | |
| D. 291,620 | 9/1987 | Porchia . | |
| D. 340,343 | 10/1993 | Rizikow . | |
| D. 362,947 | 10/1995 | Baker . | |
| 1,178,572 | 4/1916 | Burbey . | |
| 1,370,811 | 3/1921 | Harding . | |
| 1,757,689 | 5/1930 | Strickland | 206/562 |
| 2,314,935 | 3/1943 | Gutterman | 206/563 |
| 2,948,452 | 8/1960 | Grogan et al. . | |
| 3,306,512 | 2/1967 | Pagnini . | |
| 3,955,672 | 5/1976 | Brundage | 206/562 |
| 4,111,305 | 9/1978 | Thomas | 206/563 |
| 4,291,805 | 9/1981 | Seeley . | |
| 4,718,555 | 1/1988 | Amberg . | |
| 4,718,594 | 1/1988 | Harazi | 229/932 |
| 5,497,885 | 3/1996 | Sussman | 206/563 |

*Primary Examiner*—David T. Fidei
*Attorney, Agent, or Firm*—John A. Haug

[57] ABSTRACT

A plurality of ice cream cone nesting sites (14) are formed on the base wall (12,12') of a carrier (10,10'). Each nesting site is formed by a nesting wall configured as a truncated cone with its diameter decreasing as the distance from the base wall increases. The bottom wall is spaced above a supporting surface on which the carrier may be placed by feet (22,22') extending downwardly from the bottom wall to facilitate grasping and handling. A lip (28) may be formed around the outer perimeter of the bottom wall to provide spill containment and to enhance gripping of the carrier.

10 Claims, 4 Drawing Sheets

CARRIER FOR ICE CREAM CONES AND THE LIKE

CROSS REFERENCES TO RELATED APPLICATIONS

Benefit is claimed of U.S. provisional application Nos. 60/061,840, filed Oct. 14, 1997 and 60/082,342, filed Apr. 20, 1998.

FIELD OF THE INVENTION

This invention relates generally to the food industry and more particularly to carriers for holding cones of ice cream and the like.

BACKGROUND OF THE INVENTION

Over the years establishments selling ice cream, frozen yogurt and the like have been vexed with problems associated with handling cones for such comestibles in an efficient manner. For example, a server has a problem of keeping track of an order to ensure that the order is being correctly filled and the customer, many times, has a problem of handling a plurality of cones while at the same time paying for the order and receiving change. Various attempts have been made to provide a holder for supporting and delivering ice cream cones to solve the above problems. For example, ice cream cone trays are shown in U.S. Pat. Nos. 4,291,805 and D261,466 comprising a tray having a plurality of conical sockets which extend downwardly from the trays with the vertex of each conical socket positioned below its respective open base. U.S. Pat. No. D362,947 shows a support having a single conical socket also with the vertex of the conical socket positioned below its open base. This approach presents a problem in that the sockets are limited to use with conical shaped ice cream cones and are not useful with generally flat-bottomed containers. Another problem is that only ice cream cones having approximately the same angle between the altitude and the side wall as that of the socket are firmly held. Ice cream cones having other angles are loosely held and subject to being jostled and damaged during handling and transporting. Yet another tray is shown in U.S. Pat. No. 4,718,555 which shows a carryout beverage tray having a complex configuration with a plurality of protrusion elements and a plurality of cup receiving cavities formed with gripping means for grasping the chime of chime-bottom cups and having a removable retaining means with openings therein receivable on the protrusion elements for use with long-stemmed items. Trays made in accordance with the latter patent require storage of separate component parts, require assembly and are cumbersome.

SUMMARY OF THE INVENTION

It is an object of the present invention to overcome the limitations of the prior art noted above. Another object is the provision of a carrier for ice cream cones and the like which is simple, inexpensive, stackable and easily stored and easily put into service. Yet another object of the invention is the provision of an ice cream carrier which can be fabricated of durable, reusable material or alternatively of material designed for single use. Yet another object of the invention is the provision of a carrier which can be disposed on a support surface in a stable manner whether fully or partially loaded with cones and with the vertexes of the cones spaced from the support surfaces.

Additional objects and features of the invention will be set forth in part in the description which follows and in part will be obvious from the description. The objects and advantages of the invention may be realized and attained by means of the instrumentalities and combinations particularly pointed out in the appended claims.

Briefly, in accordance with the invention, a carrier comprises a base wall having at least one and preferable a plurality of ice cream cone nesting sites each of which is formed of a truncated conical wall extending upwardly, having an open base at the base wall and a decreasing diameter as the altitude above the base increases. The top distal end of each nesting site forms a generally circular opening having a diameter selected so that it is less than that of the base portion of the largest conventional ice cream cone. Preferably, the truncated conical wall is formed with resilient, spring means at the top distal end to resiliently grasp a cone received in the cone receiving opening. As a result, cones of various sizes and types can be received in the open distal end and be securely and firmly held by the distal end wall portion. The carrier can be formed of durable, reusable plastic or the like or of material intended for a single use such as paper fiber or foam plastic or the like and can be configured in any convenient configuration, curved or polygonal. In one embodiment a hollow conical foot is provided at each corner of a rectangular carrier, open at its base to facilitate stacking of the carriers for storage and to position the bottom wall of the carrier above the surface of a support on which the carrier is received thereby allowing a person to easily grasp, lift and carry the carrier. In a second embodiment a side wall extends downwardly from the base wall and flares outwardly with feet formed by a continuation of the walls at the corners of the carrier. If desired, an upwardly extending lip can be formed on the bottom wall extending around the perimeter of the carrier for convenient handling and drip containment. In use, the bottom portion of a conventionally sized ice cream cone is inserted into the opening in the distal end of a nesting site with the cone being gripped by the distal end of the nesting site side wall to firmly hold the cone with the ice cream spaced above the distal end so that the cone can be easily picked up by one's fingers without touching the ice cream. Cones having different side wall angles relative to their altitudes, as well as different sizes and even different types such as flat-bottomed cup shaped wafer containers having a conventional larger diameter at the top opening relative to their base can be accommodated in the nesting sites.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings.

DETAILED DESCRIPTION OF THE PREFERRED EMBODIMENTS

Figure 1:
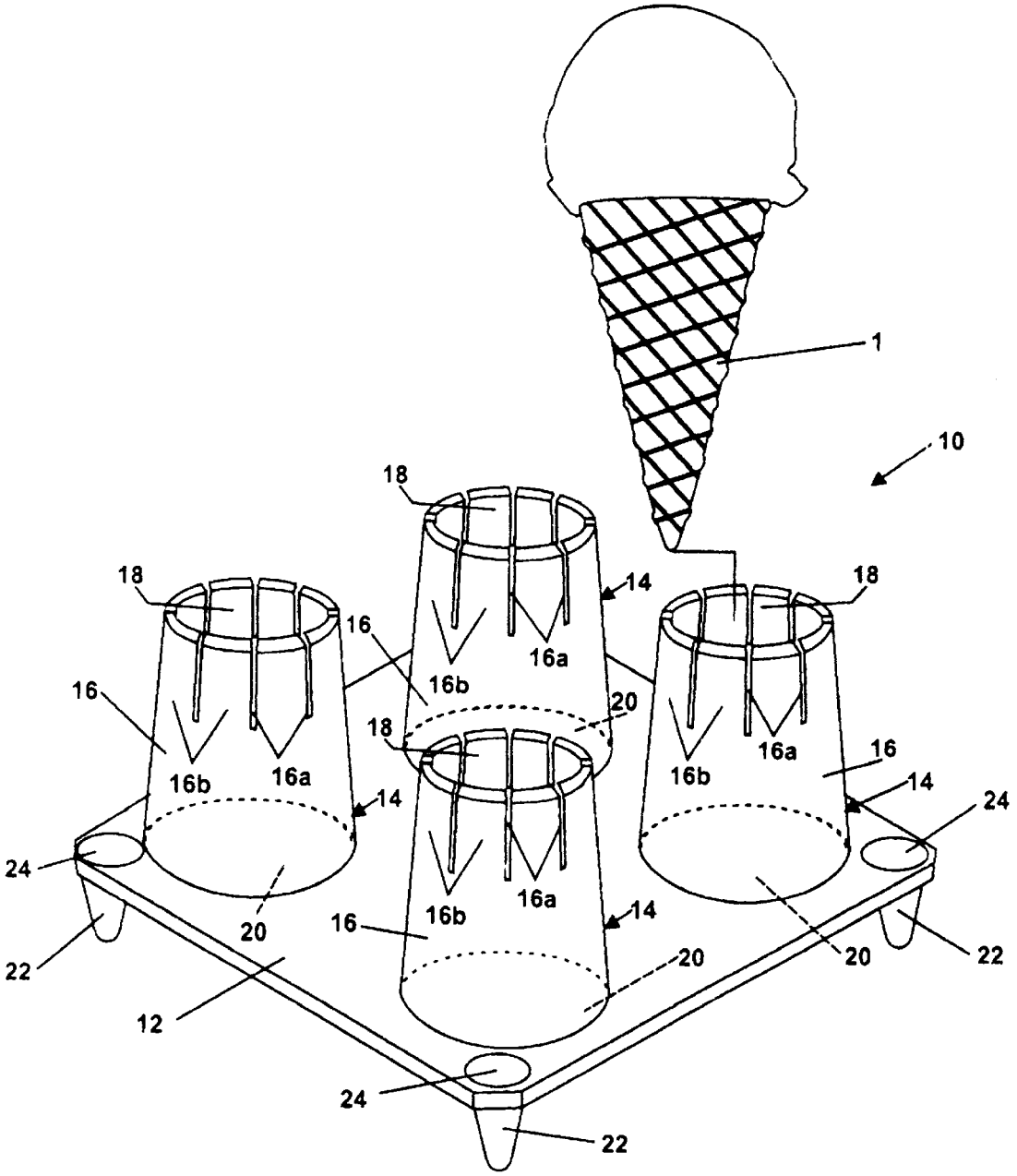
FIG. 1 is a perspective view of an ice cream cone carrier made in accordance with a first embodiment of the invention.
Figure 2:
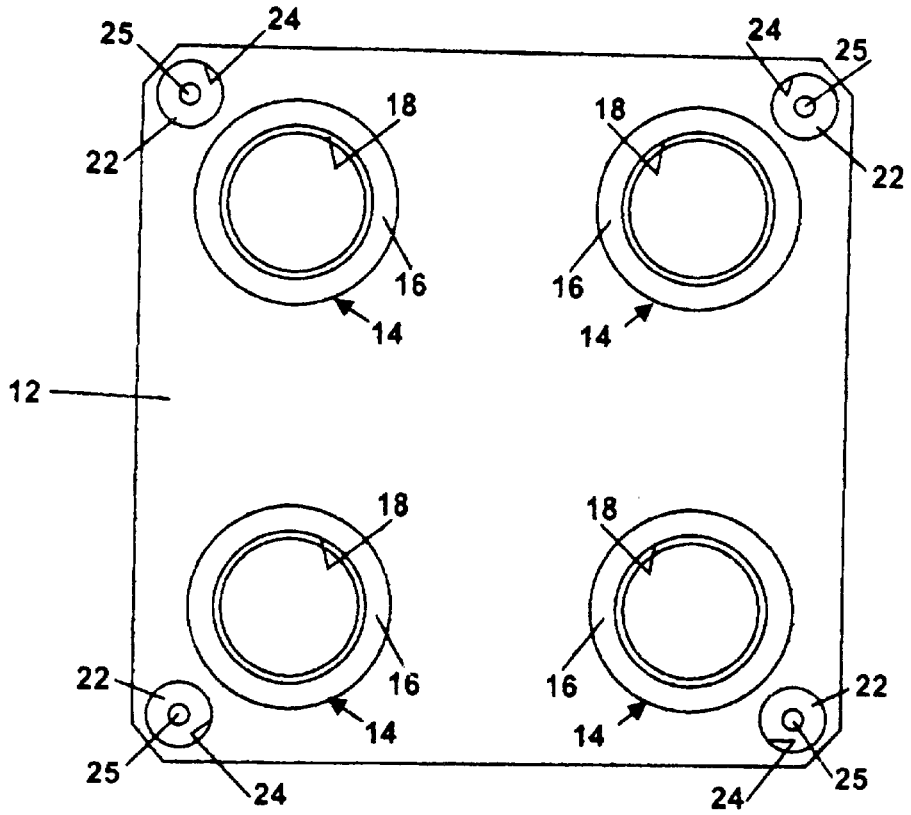
FIG. 2 is a top plan view of the FIG. 1 carrier.
Figure 3:
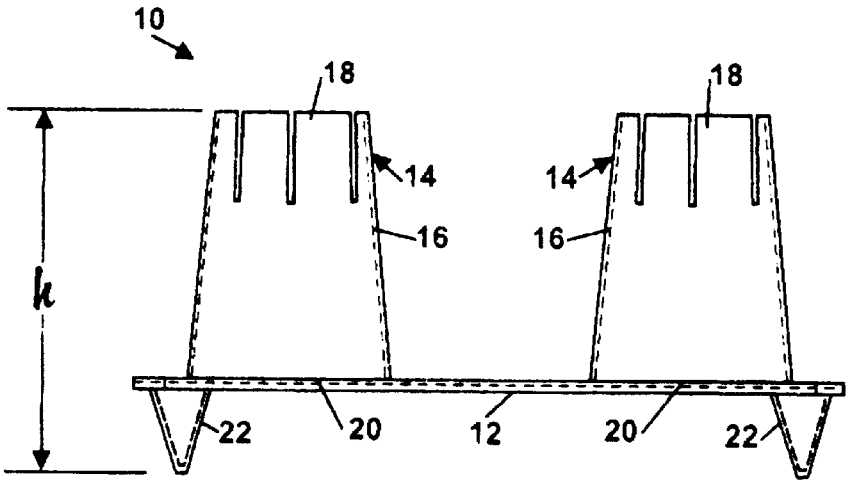
FIG. 3 is an elevational view of any one of the sides of the FIG. 1 carrier.
Figure 4:
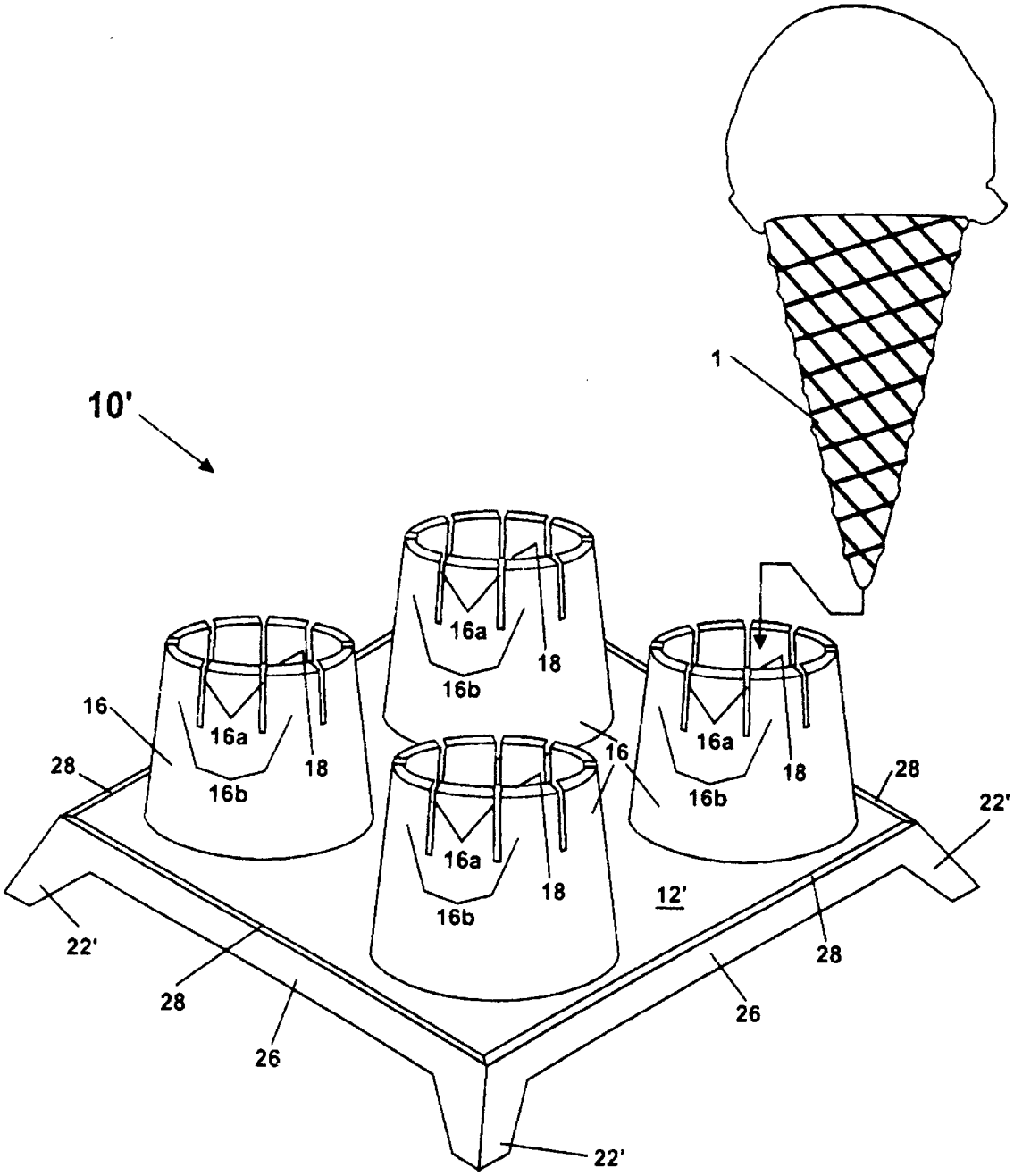
FIG. 4 is a perspective view similar to FIG. 1 of a carrier made in accordance with a second embodiment of the invention.

A cone carrier 10 made in accordance with the invention comprises a generally square base or bottom wall 12 having four cone nesting sites 14. It will be understood that the base wall could be of any convenient shape including a curved perimeter as well as polygonal and that the number of nesting sites is a matter of choice. Nesting sites 14 each comprises a hollow truncated conical wall 16 having a generally circular opening at the distal top end 18 and at the bottom or base 20. The diameter of wall 16 decreases as the altitude increases, i.e., in the distance from bottom wall 12. Preferably, nesting sites 14 are formed with resilient spring means at the distal top end thereof to resiliently grasp a cone received in the cone receiving opening, for example, as shown in FIG. 1, and FIG. 4 to be discussed below, by forming spaced, axially extending slots 16*a* in the upper portion of walls 16 extending to the distal top end to form a plurality of resilient fingers 16*b*. It will be understood that other suitable spring means could be employed, if desired, to provide resilient cone grasping means at the top distal ends 18. A foot 22 extends downwardly from a location adjacent each beveled corner of base wall 12. Feet 22 serve to elevate bottom wall 12 from a support surface on which the carrier is placed to provide a convenient place to grasp the carrier for handling. As shown in FIGS. 1–3, feet 22 are generally conical having a decreasing diameter as the distance increases from the bottom wall and preferably are hollow having an opening 24 in the bottom wall so that the carriers can be stacked one on top of another more efficiently. Preferably, a drainage opening 25 is formed in the vertex of each foot. Carriers 10 may be formed of any suitable moldable material such as plastic for a durable, reusable version or a paper fiber or foam plastic or the like for a single use version. The distal end 18 of wall 16 of each nesting site is formed with an opening selected to support conventional waffle type conical cones 1 shown in FIG. 1 or the flat-bottomed wafer type cone having a larger open end than its bottom end. Carriers constructed in accordance with the invention have been found to be effective having a diameter of approximately 1.5 inches for the opening at distal top end 18 disposed a distance h of approximately 3.75 inches from the bottom most portion of feet 22.

Figure 5:
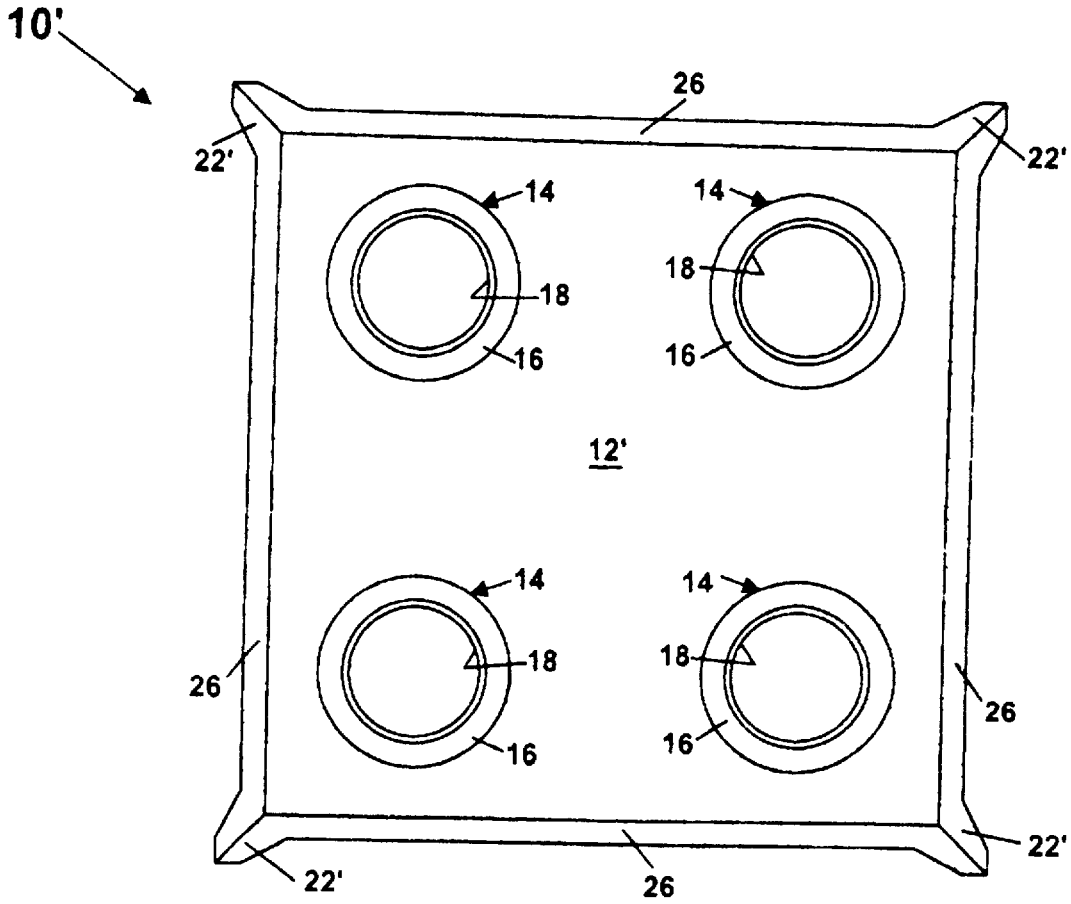
FIG. 5 is a top plan view of the FIG. 4 carrier.
Figure 6:
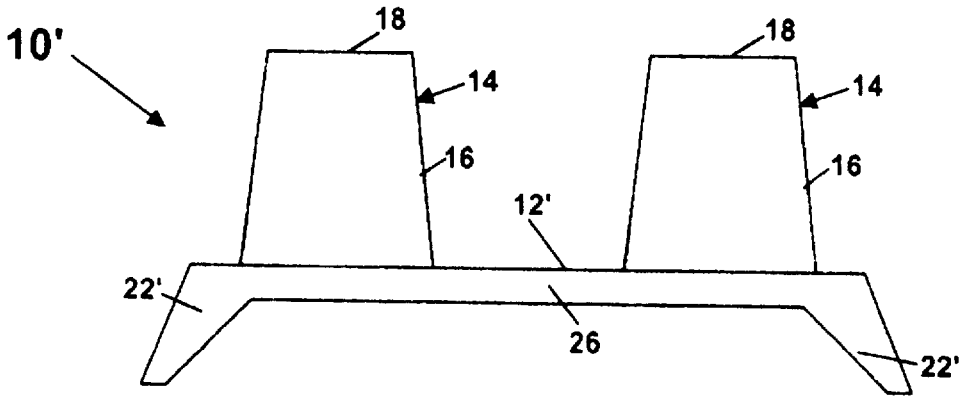
FIG. 6 is an elevational view of any one of the sides of the FIG. 4 carrier.

A modified embodiment is shown in FIGS. 4–6 in which side walls 26 depend downwardly from bottom wall 12' and are flared outwardly with feet 22' formed by a continuation of the side walls at each corner of bottom wall 12'. FIG. 4 shows an optional lip 28 which extends upwardly from bottom wall 12' and is formed all around the outer perimeter. This lip not only can be used to contain spills but also facilitates separating a carrier from a stack and grasping such carrier for handling.

It will be seen that carriers made in accordance with the invention offer a number of advantages. The carriers can firmly support various sized and shaped cones, for example, a conventional waffle cone 1 shown in FIGS. 1,4 which is conical in shape or the wafer type cone which has a flat bottom with an open end having a diameter somewhat larger than the diameter of the bottom of the cone. The carriers can be fabricated out of durable material for reuse or they can be formed of paper fiber or foam plastic for single use. The carriers allow a server to handle a plurality of various sized cones at any given occasion as well as to carry one or more carriers and contents to a distribution location for delivery to a customer. The server is able to view the entire order to ensure that it has been filled correctly before totaling the sale. The carrier and contents can be supported on a counter or the like while money is being exchanged. This allows more efficient processing and more orderly lines of customers with less congestion. The carrier also enables a user to reposition a cone in the carrier in order to attend to other needs, such as caring for children. The optional lip provides a spill containment barrier as well as enabling a user to more easily grasp the carrier for handling purposes and facilitates separation of a carrier from a stack.

Although the invention has been described with regard to a certain preferred embodiment thereof, variations and modifications will become apparent to those skilled in the art. It is, therefore, the intention that the appended claims be interpreted as broadly as possible in view of the prior art to include all such variations and modifications.

What is claimed:

1. A carrier for frozen dessert cones comprising, a base wall having an outer perimeter and a plurality of cone nesting sites, each cone nesting site having a nesting wall forming a truncated cone having a base and an altitude, the base formed with an opening in the base wall, the nesting wall having a diameter that decreases as the altitude from the base increases, and the nesting wall extending upwardly from the base wall to define a generally circular cone receiving opening at a distal end, the distal end forming a cone receiving support, a side wall extending downwardly and flaring outwardly from the base wall and a plurality of outwardly flaring feet formed by a continuation of the side wall at spaced apart locations of the side wall around the outer perimeter.

2. A carrier for frozen dessert cones according to claim 1 in which resilient cone grasping means are formed at the opening in the distal end of the nesting wall.

3. A carrier for frozen dessert cones according to claim 2 in which the cone grasping means comprises a plurality of generally axially extending resilient fingers.

4. A carrier for frozen dessert cones according to claim 1 which the outer perimeter of the carrier is polygonal.

5. A carrier for frozen dessert cones according to claim 1 in which the circular cone receiving opening in the distal end has a diameter of approximately 2.5 inches.

6. A carrier for frozen dessert cones according to claim 3 in which the circular cone receiving opening in the distal end has a diameter of approximately 2.5 inches.

7. A carrier for frozen dessert cones according to claim 1 further comprising a lip extending upwardly from the bottom wall and extending all around the outer perimeter of the base wall.

8. A carrier for frozen dessert cones having a generally rectangular base wall with a plurality of cone nesting sites formed thereon, each cone nesting site comprising a nesting wall configured as a truncated cone, the truncated cone having a base at the bottom wall and having an altitude and a diameter which decreases with an increasing altitude, the truncated cone being hollow and having an opening through the base wall at the base thereof and at a distal end spaced above the bottom wall, and a foot extending downwardly from the bottom wall at each corner of the base wall and further comprising a side wall extending downwardly and flaring outwardly from the base wall, the feet formed by a continuation of the side wall at the corners of the base wall.

9. A carrier for frozen dessert cones according to claim 8 in which resilient cone grasping means are formed at the opening in the distal end of the nesting wall.

10. A carrier for frozen dessert cones according to claim 9 in which the cone grasping means comprises a plurality of generally axially extending resilient fingers.

* * * * *